US008739700B2

(12) United States Patent
Igarashi et al.

(10) Patent No.: US 8,739,700 B2
(45) Date of Patent: Jun. 3, 2014

(54) SCREEN PRINTER INCLUDING FILM SUCTION MECHANISM AND AUXILIARY STAGES

(75) Inventors: Akio Igarashi, Tsuchiura (JP); Makoto Homma, Katori (JP); Naoaki Hashimoto, Ryugasaki (JP); Tomoyuki Yahagi, Ryugasaki (JP)

(73) Assignee: Hitachi Ltd, Tokyo (JP)

( * ) Notice: Subject to any disclaimer, the term of this patent is extended or adjusted under 35 U.S.C. 154(b) by 522 days.

(21) Appl. No.: 13/019,579

(22) Filed: Feb. 2, 2011

(65) Prior Publication Data

US 2011/0192295 A1 Aug. 11, 2011

(30) Foreign Application Priority Data

Feb. 5, 2010 (JP) ..... 2010-023855

(51) Int. Cl.
*B41F 15/20* (2006.01)
*B41L 13/02* (2006.01)

(52) U.S. Cl.
USPC ..... 101/126; 101/114

(58) Field of Classification Search
USPC ..... 101/123, 126, 114
See application file for complete search history.

(56) References Cited

U.S. PATENT DOCUMENTS

| | | | | |
|---|---|---|---|---|
| 4,307,961 | A * | 12/1981 | Blitchington et al. | 356/400 |
| 5,124,728 | A * | 6/1992 | Denda | 346/134 |
| 5,752,446 | A * | 5/1998 | Squibb | 101/486 |
| 6,367,378 | B1 * | 4/2002 | Yamazaki | 101/129 |
| 2007/0227372 | A1 * | 10/2007 | Tsunekawa et al. | 101/123 |
| 2008/0121124 | A1 * | 5/2008 | Sato | 101/123 |

FOREIGN PATENT DOCUMENTS

JP 2004-356268 12/2004

* cited by examiner

*Primary Examiner* — Leslie J Evanisko
(74) *Attorney, Agent, or Firm* — Antonelli, Terry, Stout & Kraus, LLP.

(57) ABSTRACT

In a printing system in which a roll film is rolled out to be printed by a printer and the film is rolled up after printing and drying, there is a possibility that wrinkles of the film are generated when printing, and printed materials are scratched because the printed film is positioned near the printer. Both end side of a suction stage in the film delivery direction are formed in a circular arc shape, and auxiliary stages are provided near the end portions to suck and hold a film, the auxiliary stages are allowed to be moved lower than a surface of the suction stage in the state to closely attach the film to the suction stage while applying tension to the film, and the film is sucked and held on the suction stage in the state to be printed after position adjustment to a surface of a mask.

9 Claims, 8 Drawing Sheets

SCREEN PRINTER INCLUDING FILM SUCTION MECHANISM AND AUXILIARY STAGES

BACKGROUND OF THE INVENTION (1) Field of the Invention

The present invention relates to a screen printer and a printing method using the same by which a predetermined pattern is printed on a surface of a film.

(2) Description of the Related Art

As a conventional device, Japanese Patent Application Laid-Open No. 2004-356268 discloses a printing device which prints and applies a solder resist to a film rolled out from a supply reel, and rolls up and collects the film.

It was found in the conventional example that even if the film is rolled up after the solder resist is printed and temporarily dried, the film can be rolled up without any problems such as peeling or friction of printed materials. Accordingly, a dedicated drying machine is not provided.

In the conventional technique, there have not been disclosed problems such as printing failure due to wrinkles generated on a film when printing, and stains and peeling of printed materials caused by contact between a previously-printed area and a screen or the like in the case where the next print area is printed after printing and before drying.

An object of the present invention is to provide a film printer by which wrinkles of a film are prevented from being generated when printing, and the film can be printed without staining previously-printed materials on the film.

SUMMARY OF THE INVENTION

In order to achieve the above-described object, in a screen printer which prints paste on a film, suction ports provided on a film mounting surface of a suction stage are divided into a plurality of blocks in the direction orthogonal to the film moving direction to be used as vacuum suction mechanisms which can discharge in the vacuum state, both end sides of the film mounting surface of the suction stage in the film delivery direction are formed in a circular arc shape, and auxiliary stages having vertically-moving mechanisms and suction units are provided on the both sides of the suction stage.

Further, the auxiliary stages are provided with film stretch mechanisms which clamp and stretch both end portions of the film in the width direction.

According to the present invention, the printer enables printing on the film while holding the film on the stages without generation of wrinkles on the film, and the film can be fed to a drying unit without contact between a print pattern on the film after printing and before drying and a mask. Accordingly, the print pattern is not stained or scratched.

DETAILED DESCRIPTION OF THE EMBODIMENT

Figure 1:
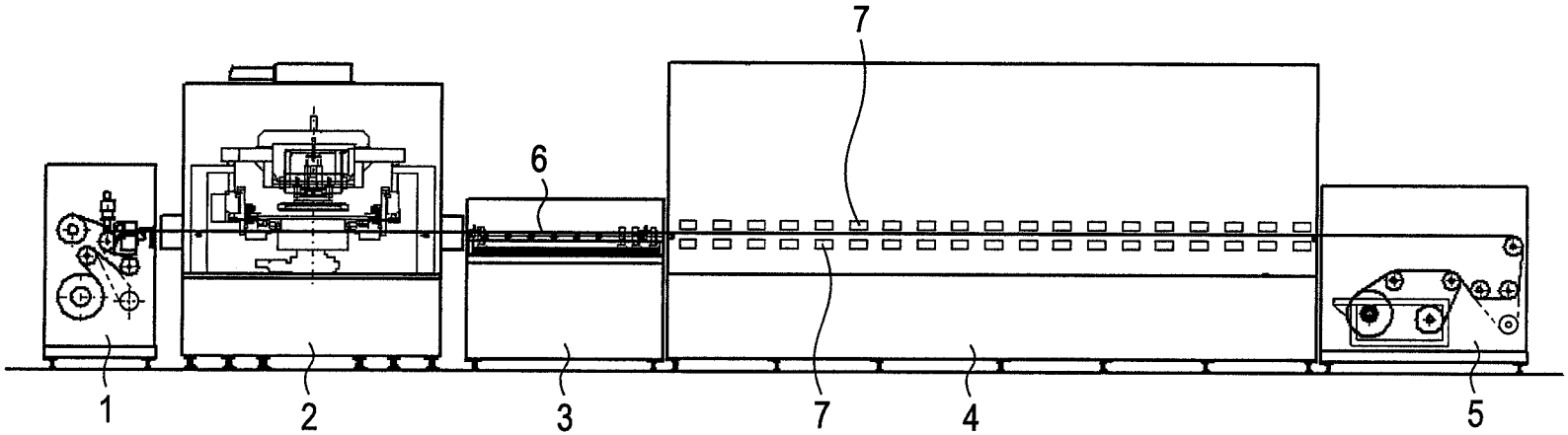
FIG. 1 is a diagram for showing the entire configuration of a film printing system.

An outline of the entire configuration of a film printing system is shown in FIG. 1.

As shown in the drawing, the system includes a film rolling-out mechanical unit 1 which feeds a roll film (printing target) 6 to a film printing unit 2, the printing unit 2 having a screen printer for printing on the film, a film feeding mechanical unit 3 which feeds the film printed by the printing unit 2, a drying unit 4 in which heaters 7 are installed while sandwiching a film moving route for drying a print pattern on the rolled-out film, and a film rolling-up mechanical unit 5 which rolls up the film on which the dried print pattern is formed (roll-to-roll method).

Figure 2:
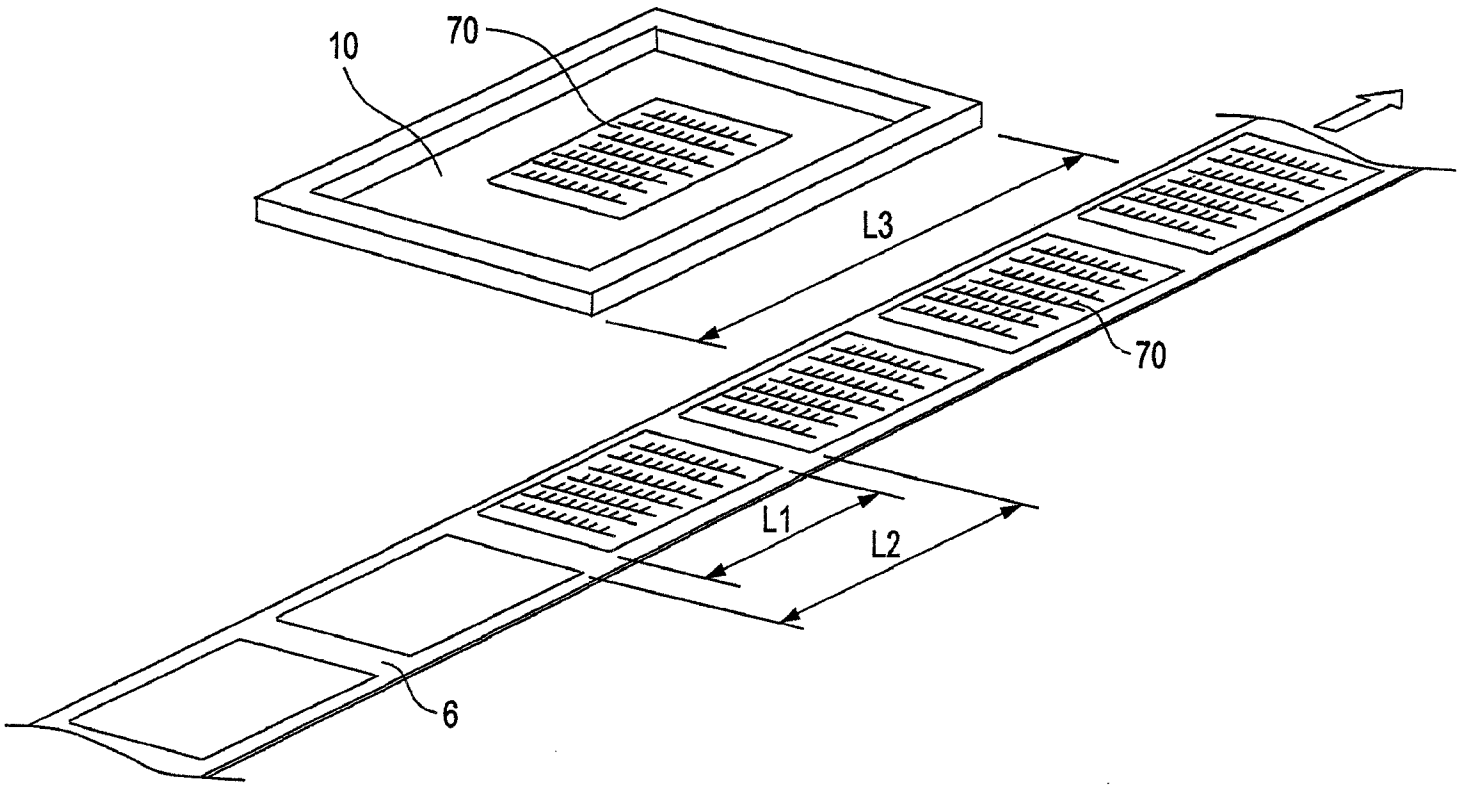
FIG. 2 PRIOR ART
FIG. 2 is a diagram for explaining problems in conventional film printing.

A general print condition is shown in FIG. 2.

If it is assumed that a print table is provided on the same plane when the print film 6 is printed and moved, a print area (print pattern 70) in the film moving direction is represented by L1, a distance to the adjacent print areas is represented by L2, and the length of a mask 10 is represented by L3 as shown in the drawing. In such a state, a relation between the distance L2 to the adjacent print areas and the length L3 of the mask 10 involves the problems described below in the following states.

1. In the case of L2<L3, when the printed pattern is moved in the moving direction by one pitch, the mask is brought into contact with the pattern to cause damage.
2. In the case of L2>L3, the printed pattern is not brought into contact with the mask, but the yield rate is deteriorated, resulting in a long time.

Accordingly, the present invention is configured to include auxiliary stages on which non-print areas or printed areas are sucked and held and which are positioned lower than a suction stage when printing, in addition to the suction stage on which the film is sucked and held for printing, so as not to cause the above-described two problems. The details thereof will be described below.

Figure 3A:
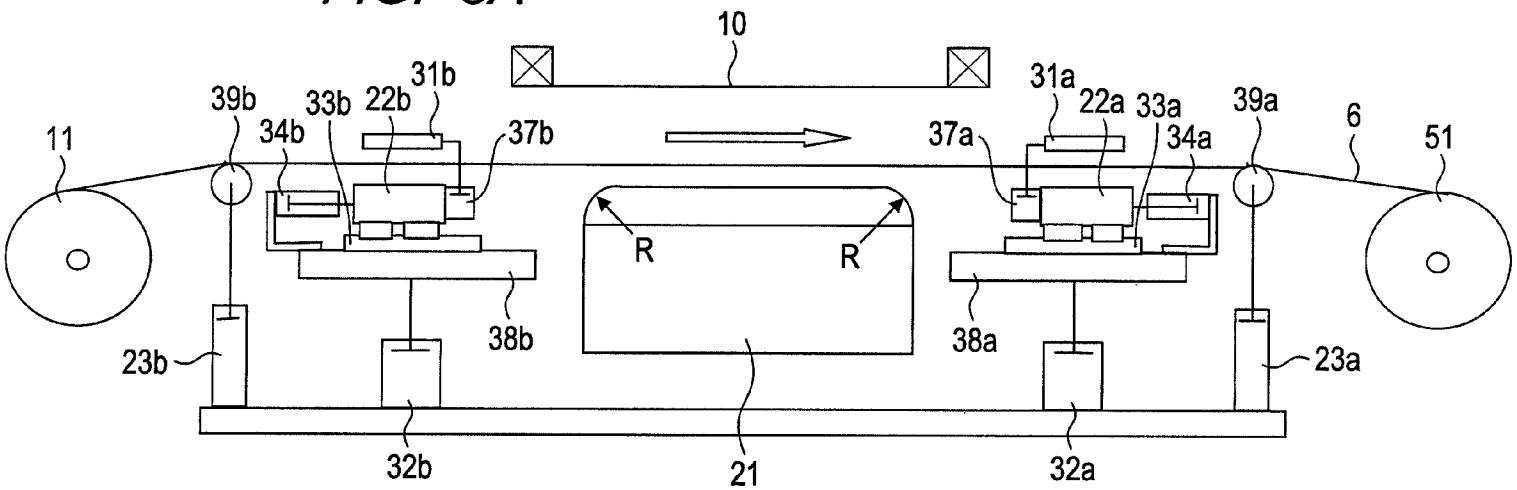
FIGS. 3A and 3B are diagrams, each showing an outlined configuration around stage units of a film printing unit.
Figure 3B:
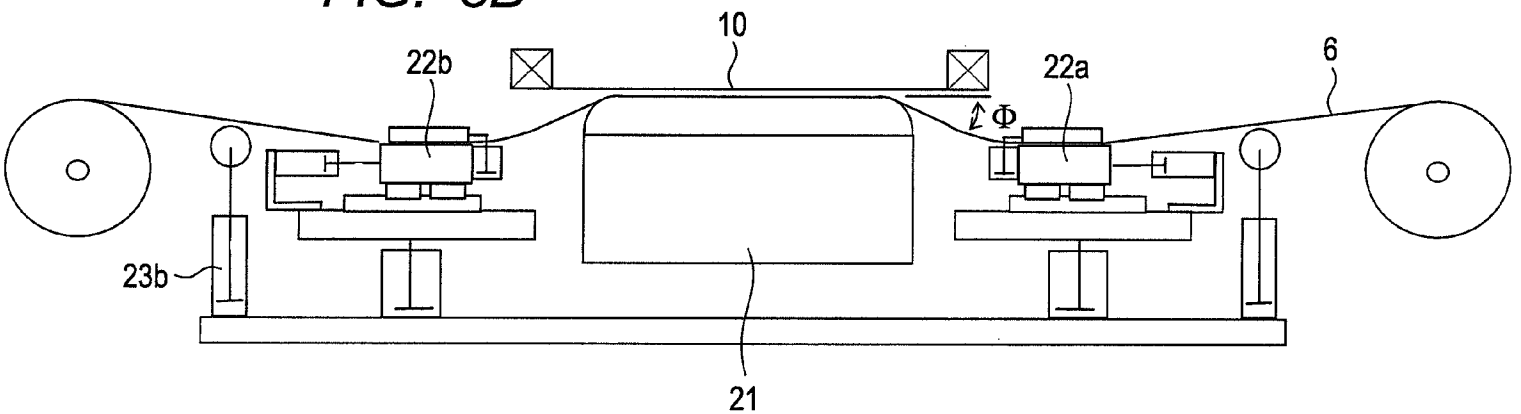

An outline around the stage units of the printer is shown in each of FIG. 3. FIG. 3A shows a state in which the film is being moved before the film is printed, and FIG. 3B shows a state in which the film is being printed.

The printer is provided at the film printing unit 2. The film 6 rolled out from a film rolling-out roll 11 is fed to the printer. In addition, the film 6 which has been printed and has passed through the film drying unit 4 is rolled up by a rolling-up roll 51. The printer is provided with a print table (suction stage) 21 on which the film 6 is sucked and held by using a negative pressure. In order to move the suction stage 21 in the horizontal direction (XYθ direction), the suction stage 21 is placed on an XYθ table (not shown). It should be noted that the suction stage 21 is configured so as not to be moved in the vertical direction. Before printing, the suction stage 21 is configured in such a manner that the film 6 is moved above (at a position apart from a surface of the suction stage by about 10 mm) the surface of the suction stage. Then, the film 6 is allowed to be moved to the position where a surface of the film 6 to be printed is located above the suction stage. Further, a plurality of suction ports 45 are provided on the suction surface of the suction stage 21, and the supply of a negative pressure to the plurality of suction ports 45 (see FIG. 4) is divided into a plurality of groups in the direction (width direction) orthogonal to the film moving direction (arrow direction), so that a negative pressure can be supplied in a group unit. When the film is sucked, the supply of a negative pressure is controlled so as to suck the film from the middle portion of the suction stage 21 first and then from the surrounding portions thereof. It should be noted that in order to supply a negative pressure to the suction ports of the suction stage 21, a negative pressure source and supply pipes are coupled to the suction stage 21, which will be described in FIG. 4. Further, both end portions of the suction stage 21 in the film moving direction with which the film 6 is brought into contact are formed in a circular arc shape having a radius R (about 30 mm to 100 mm).

Auxiliary stages 22*a* and 22*b* are provided on the both sides of the suction stage 21 in the film moving direction. The auxiliary stages 22*a* and 22*b* are provided on auxiliary stage bases 38*a* and 38*b*, and can be moved in the film delivery direction along linear rails 33*a* and 33*b* provided on the auxiliary stage bases 38*a* and 38*b*, respectively. The auxiliary stages are configured to be moved in the film delivery direction by pushers 34*a* and 34*b* provided at the auxiliary stages. Further, film retainers 31*a* and 31*b* for retaining the film are provided above the auxiliary stages on the both end sides in the film width direction. The film retainers 31*a* and 31*b* are configured in such a manner that they are moved in the vertical direction by film retainer vertically-moving cylinders 37*a* and 37*b* provided at the auxiliary stages 22*a* and 22*b*, and the end portions of the film are clamped and retained between the film retainers 31*a* and 31*b* and the surfaces of the auxiliary stages. Further, the film retainers are configured to be able to move in the direction where the film is stretched outward in the film width direction. The details thereof will be described in FIG. 7. Auxiliary stage vertically-moving mechanisms which include auxiliary stage vertically-moving cylinders 32*a* and 32*b* for vertically moving the auxiliary stages 22*a* and 22*b* are provided under the auxiliary stage bases 38*a* and 38*b*, respectively. Further, vertically-moving rollers 39*a* and 39*b* are provided in the rear (the downstream side) of the auxiliary stage 22*a* and in front of (the upstream side) of the auxiliary stage 22*b*, respectively, to keep a certain distance between the film and the surface of the suction stage 21. The vertically-moving rollers 39*a* and 39*b* are configured to be vertically moved by cylinders 23*a* and 23*b*, respectively. The descent of the vertically-moving rollers allows the film 6 to be brought into contact with the surfaces of the auxiliary stages 22*a* and 22*b* and the surface of the suction stage 21.

It should be noted that a plurality of suction ports (not shown) are provided also on the surfaces of the auxiliary stages so as to supply a negative pressure to the suction ports when holding the film.

In the case where the film is allowed to be sucked on the suction stage 21, the vertically-moving rollers 39*a* and 39*b* are allowed to descend so that the film 6 is brought into contact with the surfaces of the auxiliary stages 22*a* and 22*b* and the surface of the suction stage 21, as shown in FIG. 3B. Next, the film 6 is sucked on the surfaces of the auxiliary stages 22*a* and 22*b* and the surface of the suction stage 21. Thereafter, the pushers 34*a* and 34*b* draw the auxiliary stages 22*a* and 22*b* to the suction stage 21, then, the film 6 becomes loosen. After that, the auxiliary stages 22*a* and 22*b* are allowed to descend so that the surfaces of the auxiliary stages 22*a* and 22*b* are positioned lower than the surface of the suction stage 21, and the film 6 is pushed against the surface of the suction stage. As described above, in the case where the surface of the suction stage 21 is positioned higher than the surfaces of the auxiliary stages 22*a* and 22*b* in the state where the film 6 is sucked, an angle Φ of the film 6 in the film moving direction relative to the horizontal direction is about 5 to 30 degrees. Because the end portions of the suction stage are formed in an R-shape as described above, even if the film is pushed down by the auxiliary stages 22*a* and 22*b*, the film can be smoothly supported without generation of scratches and wrinkles on the film.

Further, the end portions of the film 6 are clamped by the film retainers 31*a* and 31*b* which holds the both end sides of the film 6 in the width direction, so that no wrinkles are generated in the film width direction. It should be noted that wrinkles generated in the film delivery direction are prevented from being generated in such a manner that the film is sucked and held on the auxiliary stages by a negative pressure, and the auxiliary stages 22*a* and 22*b* are allowed to descend lower than the surface of the suction stage 21 to closely attach the film 6 to the surface of the suction stage while applying tension to the film 6. The vertically-moving rollers 39*a* and 39*b* disposed outside the auxiliary stages are allowed to descend to the position where they are not brought into contact with the film when the auxiliary stages are allowed to descend. Further, a frame vertically-moving mechanism (not shown) is provided at the main body of the printer so as to vertically move a frame 10*a* in which a mask (or referred to as a screen) 10 is mounted.

Figure 4:
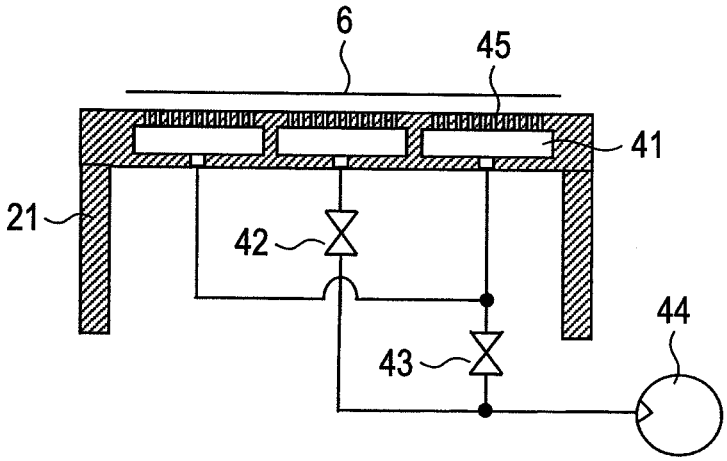
FIG. 4 is an outlined cross-sectional view of a suction stage in the film width direction.

A cross section of the suction stage in the film width direction is shown in FIG. 4.

As shown in FIG. 4, a plurality of suction ports 45 are provided on the stage surface of the suction stage 21, and a plurality of sectioned chambers 41 are provided under the suction ports 45. Porous material may be used for the suction ports 45. FIG. 4 shows a configuration in which the chambers are sectioned into three blocks in the width direction of the suction stage 21. Pipes are provided at the respective chambers to supply a negative pressure. As shown in the drawing, vacuum valves 42 and 43 are provided at the pipe for the middle chamber and the pipe for the right and left chambers, respectively, and the supply of a negative pressure to the chambers is controlled by opening or closing the vacuum valves. In addition, the respective pipes are coupled to a vacuum pump 44. When the film 6 is sucked, the vacuum valve 42 is opened, and then the vacuum valve 43 is opened after a short interval. Accordingly, it is possible to suck the film 6 while preventing the generation of wrinkles because the film is sucked from the middle.

Figure 5B:
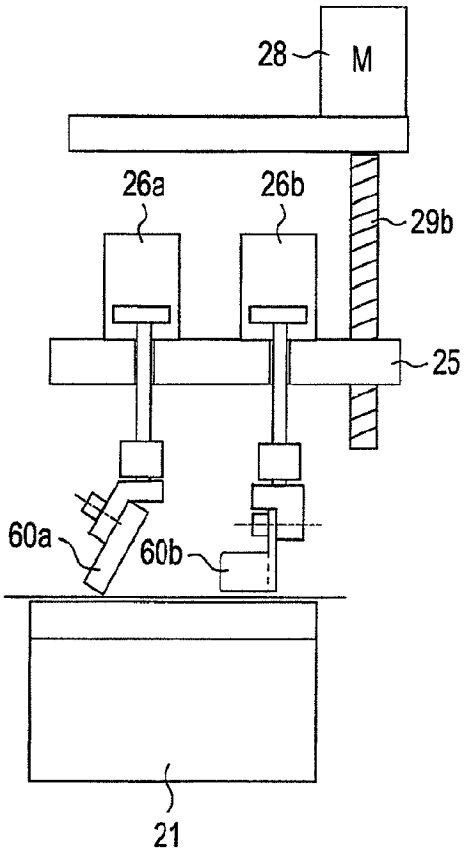
FIGS. 5A and 5B are diagrams, each showing an outlined configuration a squeegee head.
Figure 5A:
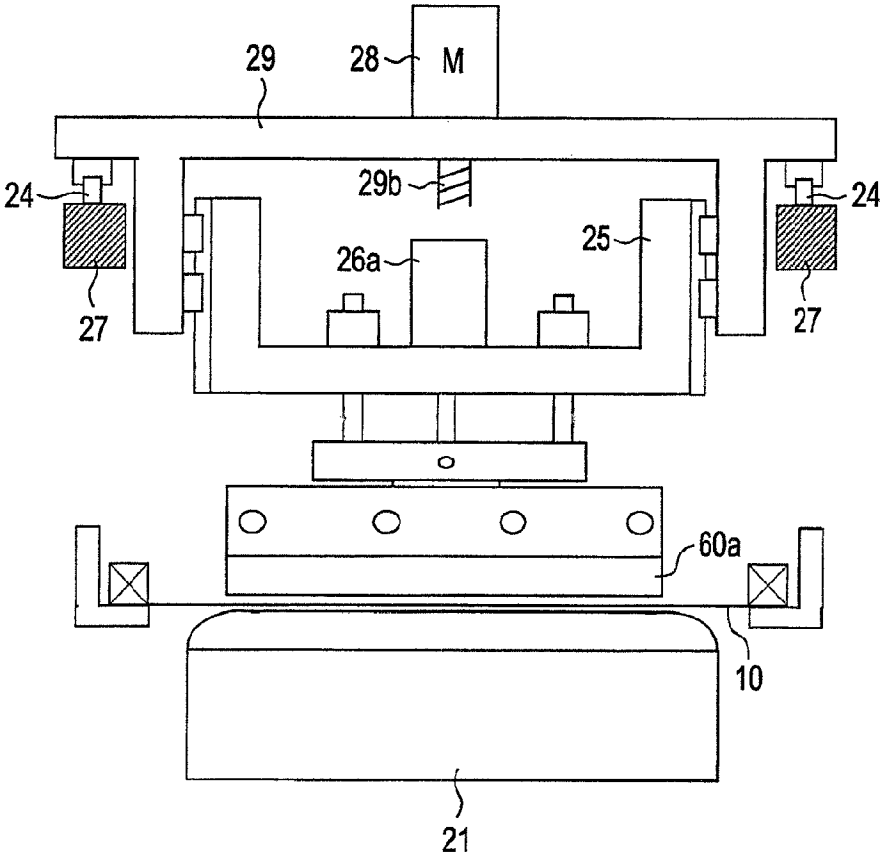

In the case where the film is printed using the mask 10, paste is squeezed into an opening portion of the mask by a squeegee. Here, a configuration of a squeegee head having the squeegee will be described. FIG. 5A shows a front cross-sectional view of an outlined configuration of the squeegee head and FIG. 5B shows a side cross-sectional view thereof. The squeegee head is provided with two kinds of vertically-driving mechanisms for applying a predetermined pressing force to the surface of the mask while allowing squeegee 60*a* and a scraper 60*b* to descend on the surface of the mask. The first driving mechanism is configured to include a ball screw 29*b* and a servo motor 28 and to vertically move a head frame 25 in which a squeegee driving mechanism and a scraper mechanism are provided. In addition, the second driving mechanism is configured to include air cylinders 26*a* and 26*b* which are provided in the head frame 25. The air cylinders 26*a* and 26*b* of the second driving mechanism are separately used for the squeegee and the scraper. The head frame 25 is provided at a squeegee head attachment frame 29 which is configured to be moved in the horizontal direction on the surface of the mask 10 by a third driving mechanism (not shown). Linear rails 24 are provided at lower portions of the both ends of the frame 29 so as to move on beams 27 provided at the device mount.

Further, the squeegee 60*a* and the scraper 60*b* are provided at the head frame 25 as described above. The driving mechanisms have two kinds of operation methods as follows: (1) the squeegee head is allowed to descend near the surface of the mask by operating the first squeegee driving mechanism (the servo motor 28 and the ball screw 29*b*), and thereafter, the squeegee 60*a* is allowed to descend so as to apply a pressing force to the squeegee to press against the mask 10 by operating the second squeegee driving mechanism 26*a*; and (2) the squeegee 60*a* is allowed to descend by operating the second squeegee driving mechanism 26*a* to lock the squeegee on the descent side with a high pressure, and thereafter, the torque is controlled by the first squeegee driving mechanism to push the squeegee 60*a* against the surface of the mask 10 with a predetermined pressing force. Instead of applying a high pressure to the squeegee 60*a*, a brake may be provided at the squeegee driving mechanism.

One of the above-described two methods can be selected for use in the device. Specifically, the above-described two methods are set in a controlling unit (not shown), and a user can select one of the two methods for use while viewing a display device provided at the controlling unit at the time of initial setting. The film is printed in such a manner that the paste supplied on the surface of mask 10 is supplied on the surface of the film from the opening portion provided on the mask 10 by operating the squeegee 60*a*. The squeegee is moved apart from the surface of the mask after printing by the squeegee and the scraper 60*b* illustrated in FIG. 5B is horizontally moved while keeping a certain clearance between the scraper 60*b* and the surface of the mask 10. Accordingly, the paste moved by the squeegee is collected at the original position and at the same time, the surface of the mask is coated, so that it is possible to prevent the opening portion of the mask from being dried and from being clogged with the paste.

Further, the explanation of the squeegee driving mechanism 26*a* and the scraper driving mechanism 26*b* is herein omitted. However, the descent stroke lengths of the squeegee 60*a* and the scraper 60*b* can be adjusted by using a down stop mechanism. Further, instead of the scraper 60*b*, the squeegee 60*a* may be attached to enable printing by reciprocating operations.

Next, a print operation will be described. Each of FIG. 6A to FIG. 7G shows transition of print states.

Figure 6A:
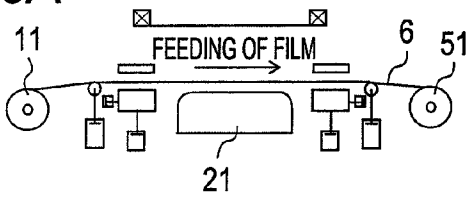
FIGS. 6A-6H are diagrams for showing a procedure of film printing.
Figure 6B:
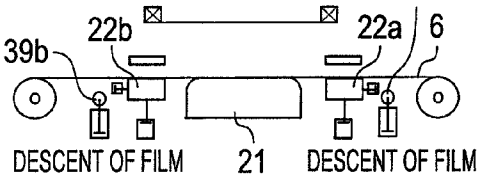
Figure 6C:
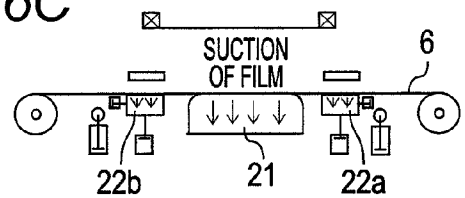
Figure 6D:
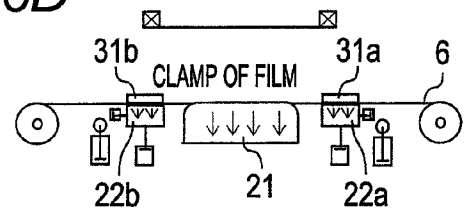

In the first place, the film 6 is rolled out to the film printing unit 2 from the film rolling-out mechanical unit 1 of FIG. 1. Next, when the position of a print surface of the film reaches on the suction stage 21, the movement of the film 6 is stopped as shown in FIG. 6A. Next, the vertically-moving rollers 39*a* and 39*b* disposed outside the auxiliary stages are allowed to descend, so that the film is allowed to descend on the surfaces of the auxiliary stages 22*a* and 22*b* and the surface of the suction stage 21, as shown in FIG. 6B. Next, a negative pressure is supplied to the auxiliary stages 22*a* and 22*b* and the suction stage 21 to suck and attach the film on the respective surfaces, as shown in FIG. 6C. Thereafter, the film retainers 31*a* and 31*b* provided at the auxiliary stages are allowed to descend on the surface of the film to clamp the end portions of the film in the width direction between the film retainers 31*a* and 31*b* and the auxiliary stages 22*a* and 22*b*, respectively, as shown in FIG. 6D. It should be noted that the film retainers 31*a* and 31*b* for retaining the end portions of the film 6 in the width direction are provided at only the auxiliary stages 22*a* and 22*b* in the drawing. However, a film retainer as similar to those for the auxiliary stages 22*a* and 22*b* may be provided even at the suction stage 21 to clamp the film therebetween, so that wrinkles of the film can be prevented from being generated by stretching the film in the width direction.

Figure 6E:
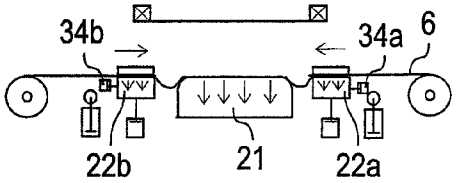
Figure 6F:
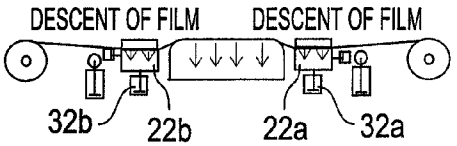
Figure 6G:
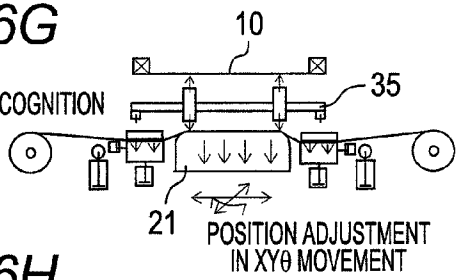
Figure 6H:
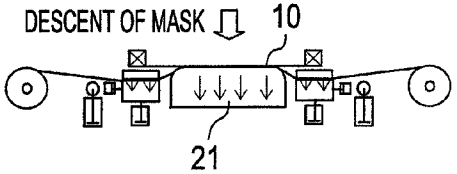

Next, the auxiliary stages 22*a* and 22*b* are allowed to be horizontally moved towards the suction stage 21 by the pushers 34*a* and 34*b*, as shown in FIG. 6E. Accordingly, the film 6 is slacked. Next, the auxiliary stages 22*a* and 22*b* are allowed to descend by operating the auxiliary stage vertically-moving cylinders 32*a* and 32*b*, so that the surfaces of the auxiliary stages are positioned lower than the surface of the suction stage, as shown in FIG. 6F. In FIG. 6G, a mark recognition camera (a camera with upper and lower two viewing fields) 35 which can image in the upper and lower directions is moved between the surface of the suction stage and the surface of the mask to image position recognition marks provided at the suction stage and the mask. The imaged data are transmitted to the controlling unit (not shown), and the position gap thereof is obtained by a position recognition unit provided at the controlling unit. On the basis of the obtained position gap, the controlling unit issues a driving command to a driving mechanism of the XYθ table to horizontally (in the XYθ direction) move the suction stage 21 by a distance corresponding to the position gap, and position adjustment of the mask and the film is performed. When the position adjustment is completed, the mark recognition camera is set back from the lower side of the mask. When the camera is completely set back, the mask is allowed to descend on the surface of the film on the suction stage.

Figure 7A:
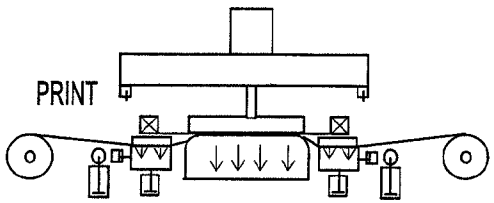
FIGS. 7A-7G are diagrams for showing the rest of the printing procedure of FIG. 6.
Figure 7B:
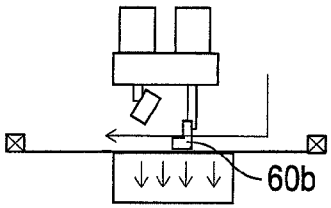
Figure 7C:
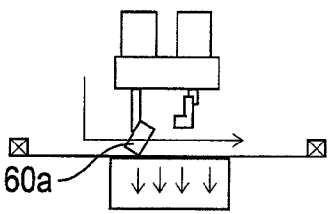

Next, the squeegee head is allowed to descend on the surface of the mask as shown in FIG. 7A. At this time, the scraper 60*b* provided at the squeegee head is allowed to descend so as to be brought into contact with the surface of the mask, and is allowed to be moved in the horizontal direction (FIG. 7B). Thereafter, the scraper 60*b* is moved apart from the surface of the mask, and the squeegee 60*a* is pushed against the surface of the mask with a predetermined pressing force. Next, the squeegee 60*a* is allowed to be horizontally moved on the surface of the mask, and the paste supplied on the surface of the mask is squeezed into the opening portion of the mask to be printed on the surface of the film (FIG. 7C).

Figure 7D:
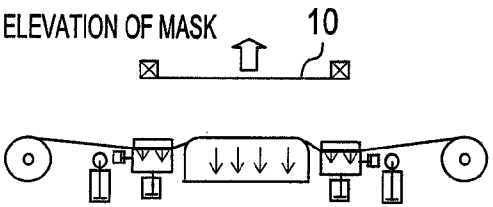
Figure 7E:
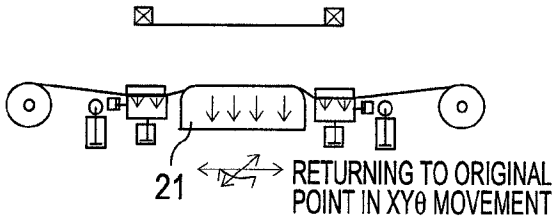
Figure 7F:
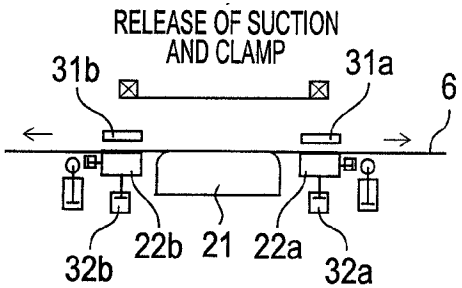
Figure 7G:
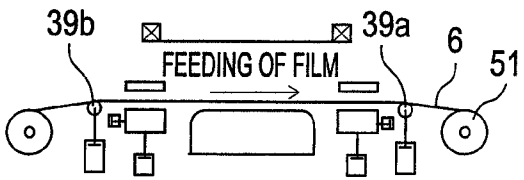

When the print is completed, the squeegee 60*a* is moved apart from the surface of the mask to elevate the squeegee head, and then the mask 10 is elevated to be moved apart from the surface of the film, as shown in FIG. 7D. When the mask 10 is completely elevated, the suction stage 21 is allowed to be horizontally moved to return to the original point, as shown in FIG. 7E. Next, the auxiliary stages 22*a* and 22*b* are allowed to be elevated, and the supply of a negative pressure to the auxiliary stages 22*a* and 22*b* and the suction stage 21 is stopped, as shown in FIG. 7F. Thereafter, the auxiliary stages 22*a* and 22*b* are allowed to be moved in the directions apart from the suction stage 21. Next, the vertically-moving rollers 39*a* and 39*b* are allowed to be elevated, and the film is moved apart from the surfaces of the auxiliary stages and the surface of the suction stage, as shown in FIG. 7G. Thereafter, the film rolling-up roller 51 is driven to rotate, and the film 6 is moved until the next print surface of the film is set. The main operations have been completely explained above.

Next, with the use of the auxiliary stage 22*a* as an example, the step (the step of FIG. 6D) of removing wrinkles while retaining the end portions in the film width direction will be described.

The film retaining operation for retaining the end portions of the film in the width direction provided on the auxiliary stage will be described by using FIGS. 8A-8H. Here, an operation on the side of the film retainer 31*a* will be described as an example. However, the same operation is performed on the side of the film retainer 31*b*. The end portions of the film 6 in the width direction are clamped between the film retainer 31*a* and the auxiliary stage to be stretched in the width direction, so that wrinkles are prevented from being generated in the width direction. As shown in the drawings, the film retainers and the driving mechanisms are provided on the right and left sides in pairs except the film retainer vertically-moving cylinder 37*a*. The film retainer 31*a* is configured to be moved in the vertical direction and the width direction (the right-left direction) by the film-retainer vertically-moving cylinder 37*a*, a first film stretch cylinder 35*a*, and a second film stretch cylinder 36*a* provided on the side of the auxiliary stage 22*a*.

Figure 8G:
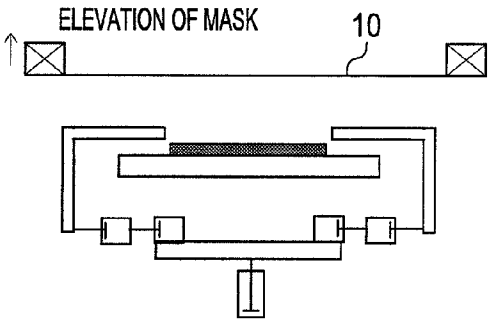
FIGS. 8A-8H are diagrams for showing an operation procedure of a film retaining mechanism provided at an auxiliary stage.
Figure 8H:
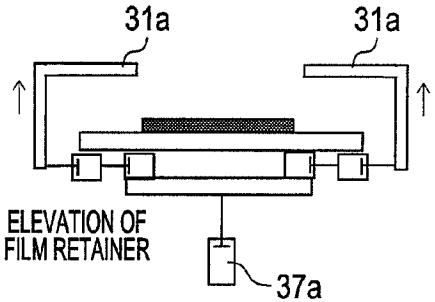
Figure 8D:
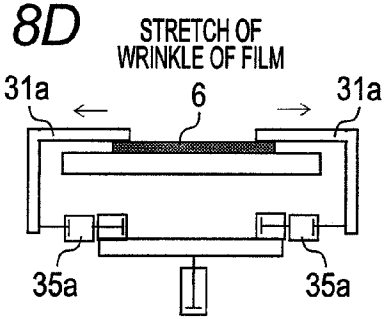
Figure 8E:
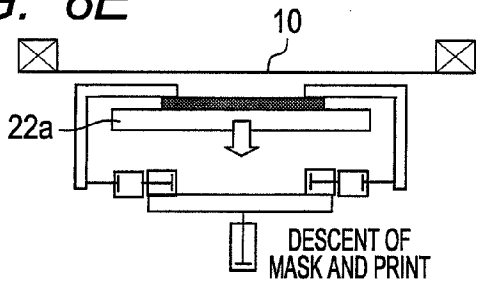
Figure 8F:
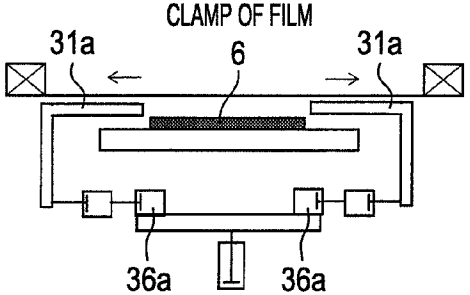
Figure 8A:
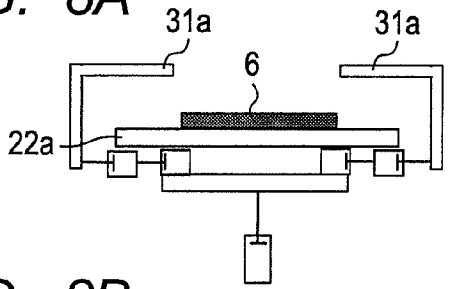
Figure 8B:
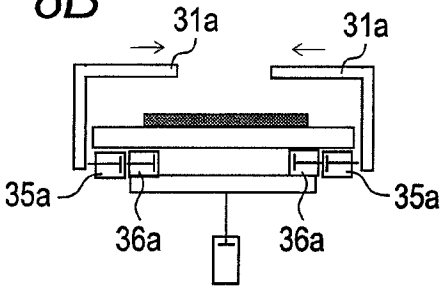
Figure 8C:
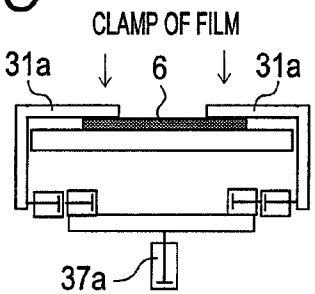

When the film 6 is sucked and held on the auxiliary stage 22*a* as shown in FIG. 8A, the first film stretch cylinder 35*a* and the second film stretch cylinder 36*a* are operated to move the film retainer 31*a* towards the middle of the auxiliary stage as shown in FIG. 8B. Next, the film retainer vertically-moving cylinder 37*a* is operated to allow the film retainer 31*a* to descend on the surface of the film, and the film 6 is clamped and retained between the film retainer 31*a* and the surface of the auxiliary stage 22*a*, as shown in FIG. 8C. When the film 6 is completely clamped, the first film stretch cylinder 35*a* is operated, and the film retainer 31*a* is moved in the direction (film width direction) where the film is stretched, as shown in FIG. 8D. Accordingly, wrinkles in the film width direction are prevented from being generated. The mask 10 is allowed to descend in the state to perform printing, as shown in FIG. 8E. The details of this step have been described above, and thus will not be repeated. When the print is completed, the second film stretch cylinder 36*a* is operated to release the holding of the film by the film retainer, as shown in FIG. 8F. When the holding of the film by the film retainer is released, the mask, the squeegee head and the like are elevated to be moved apart from the surface of the film, as shown in FIG. 8G. Thereafter, when the mask 10 is moved apart from the auxiliary stage 22*a*, the film retainer vertically-moving cylinder 37*a* is driven, so that the film retainer 31*a* is elevated from the surface of the auxiliary stage, as shown in FIG. 8H. This operation corresponds to the step of FIG. 7F as described above.

Thereafter, the film feeding mechanical unit 3 of FIG. 1 is driven to feed the film 6 by a predetermined length (until the next print surface of the film reaches on the suction stage), and the film rolling-up mechanical unit 5 is simultaneously driven to roll up the film 6 on which the print pattern is dried. In line with the driving of the film rolling-up mechanical unit 5, a part of the film 6 on which printing is completed is fed to the film drying unit 4 through the film feeding mechanical unit 3. The heaters 7 are disposed at the drying unit 4 while sandwiching the film moving route, and the film is dried in the drying unit 4. It should be noted that the film 6 is repeatedly stopped at every print area for printing, and thus the length of the drying unit 4 is set in such a manner that the print areas can be sufficiently dried during the time the film is stopped. The film 6 whose print surface is dried is fed to the film rolling-up mechanical unit 5 to be rolled up.

It should be noted that feeding rollers and dancing rollers are provided at the film rolling-out mechanical unit and the film rolling-up mechanical unit so as to prevent wrinkles from being generated on the film and to apply desired tension to the film.

With the above-described configuration and operation, the film is printed in such a manner that the roll film 6 is rolled out to be fed to the printing unit, and is sucked and held in the vacuum state on the suction stage provided at the printing unit while applying tension in the film feeding and width directions so as not to generate wrinkles. In addition, the film is held so as to be positioned lower than the surface of the suction stage, so that the film feeding direction prevents damage of the printed image caused by contact between the surface of the printed film and the mask and the like. Accordingly, high-definition print can be realized.

What is claimed is:

1. A screen printer for printing paste on a film, the screen printer comprising:

a suction mechanism divided into a plurality of blocks provided on a film mounting surface of a suction stage, with both end portions of the film mounting surface of the suction stage formed in a circular arc shape, in a film feeding direction;

auxiliary stages having suction units, provided on a downstream side and an upstream side of the suction stage, in the film feeding direction;

vertically-moving film retaining mechanisms provided with the auxiliary stages, for retaining end faces of the film in the width direction on the auxiliary stages; and film stretch mechanisms for stretching the film in the width direction.

2. The screen printer according to claim 1, comprising:

vertically-moving rollers provided on the upstream side of an upstream-side auxiliary stage of the auxiliary stages, and on the downstream side of a downstream-side auxiliary stage of the auxiliary stages, and selectably elevatable when the film is moved, so that the film can be moved while avoiding contact with a surface of the suction stage and surfaces of the auxiliary stages.

3. The screen printer according to claim 2, comprising:

vertically-moving mechanisms included in the auxiliary stages, and selectably driven when the film is printed, so that the film suction surfaces of the auxiliary stages are positioned lower than the film suction surface of the suction stage.

4. The screen printer according to claim 2, comprising:

a first squeegee vertically-driving mechanism which enables vertical movement of a squeegee using a ball screw and a servo motor;

a second squeegee vertically-driving mechanism which enables vertical movement of the squeegee using air cylinders; and wherein the first and second squeegee vertically-driving mechanisms are configured to effect;

while the squeegee is allowed to be moved to the position located apart from a surface of a mask by a predetermined distance by the first squeegee vertically-driving mechanism, a predetermined pressing force to press the squeegee against the surface of the mask is applied by the second squeegee vertically-driving mechanism; or while a braking force is applied to the second squeegee vertically-driving mechanism to lock the vertical movement of the squeegee on a descent side, the squeegee is allowed to be brought into contact with the surface of the mask by the first squeegee vertically-driving mechanism, and a predetermined pressing force to press the squeegee against the surface of the mask is applied by the first squeegee vertically-driving mechanism.

5. The screen printer according to claim 4, comprising:

a frame vertically-moving mechanism which vertically moves a frame in which a screen is mounted;

an XYθ stage mechanism which moves the suction stage in the XYθ direction in order to align the film provided on the suction stage with the screen;

a camera with upper and lower two viewing fields which images positional adjustment marks for the screen and the film; and a camera driving mechanism which moves the camera with upper and lower two viewing fields in the horizontal direction.

6. The screen printer according to claim 5, comprising:

a film rolling-out mechanism which rolls out the film;

a film feeding mechanism which feeds a predetermined length of the film; and a film rolling-up mechanism which rolls up the film after printing.

7. The screen printer according to claim 1, comprising:

a first squeegee vertically-driving mechanism which enables vertical movement of a squeegee using a ball screw and a servo motor;

a second squeegee vertically-driving mechanism which enables vertical movement of the squeegee using air cylinders; and wherein the first and second squeegee vertically-driving mechanisms are configured to effect;

while the squeegee is allowed to be moved to the position located apart from a surface of a mask by a predetermined distance by the first squeegee vertically-driving mechanism, a predetermined pressing force to press the squeegee against the surface of the mask is applied by the second squeegee vertically-driving mechanism; or while a braking force is applied to the second squeegee vertically-driving mechanism to lock the vertical movement of the squeegee on a descent side, the squeegee is allowed to be brought into contact with the surface of the mask by the first squeegee vertically-driving mechanism, and a predetermined pressing force to press the squeegee against the surface of the mask is applied by the first squeegee vertically-driving mechanism.

8. The screen printer according to claim 7, comprising:

a frame vertically-moving mechanism which vertically moves a frame in which a screen is mounted;

an XYθ stage mechanism which moves the suction stage in the XYθ direction in order to align the film provided on the suction stage with the screen;

a camera with upper and lower two viewing fields which images positional adjustment marks for the screen and the film; and a camera driving mechanism which moves the camera with upper and lower two viewing fields in the horizontal direction.

9. The screen printer according to claim 8, comprising:

a film rolling-out mechanism which rolls out the film;

a film feeding mechanism which feeds a predetermined length of the film; and a film rolling-up mechanism which rolls up the film after printing.

* * * * *